US007631508B2

(12) United States Patent
Braun et al.

(10) Patent No.: US 7,631,508 B2
(45) Date of Patent: Dec. 15, 2009

(54) APPARATUS AND METHOD FOR DETERMINING REFRIGERANT CHARGE LEVEL

(75) Inventors: James E. Braun, West Lafayette, IN (US); Haorong Li, Omaha, NE (US)

(73) Assignee: Purdue Research Foundation, West Lafayette, IN (US)

( * ) Notice: Subject to any disclaimer, the term of this patent is extended or adjusted under 35 U.S.C. 154(b) by 305 days.

(21) Appl. No.: 11/624,377

(22) Filed: Jan. 18, 2007

(65) Prior Publication Data

US 2007/0163276 A1 Jul. 19, 2007

Related U.S. Application Data

(60) Provisional application No. 60/760,012, filed on Jan. 18, 2006.

(51) Int. Cl.
*F25B 45/00* (2006.01)
*F25B 49/00* (2006.01)
*G01K 13/00* (2006.01)

(52) U.S. Cl. ..... 62/149; 62/126; 62/127; 62/129

(58) Field of Classification Search ..... 62/149, 62/127, 129, 126
See application file for complete search history.

(56) References Cited

U.S. PATENT DOCUMENTS

| | | | | |
|---|---|---|---|---|
| 5,239,865 | A | 8/1993 | Salzer et al. | |
| 6,101,820 | A | 8/2000 | Cheballah | |
| 6,128,910 | A * | 10/2000 | Faircloth | 62/129 |
| 6,308,523 | B1 | 10/2001 | Scaringe | |
| 6,571,566 | B1 * | 6/2003 | Temple et al. | 62/129 |
| 6,658,373 | B2 | 12/2003 | Rossi et al. | |
| 7,114,343 | B2 | 10/2006 | Kates | |
| 2003/0055603 | A1 | 3/2003 | Rossi et al. | |

* cited by examiner

*Primary Examiner*—Frantz F Jules
*Assistant Examiner*—Cassey Bauer
(74) *Attorney, Agent, or Firm*—Hartman & Hartman, P.C.; Gary M. Hartman; Domenica N. S. Hartman

(57) ABSTRACT

A method and apparatus for non-invasively determining a charge level of a refrigerant in a vapor-compression cycle system. The method and apparatus monitor the system while the system is operated to ascertain that the system is operating at approximately steady-state. The superheat and the subcooling of the system are then determined at the suction line and at the liquid line, respectively, and the refrigerant charge level is calculated based on the determined subcooling, the determined superheat, and rated operating conditions of the system, including rated refrigerant charge level, rated liquid line subcooling, and rated suction line superheat.

14 Claims, 1 Drawing Sheet

APPARATUS AND METHOD FOR DETERMINING REFRIGERANT CHARGE LEVEL

CROSS REFERENCE TO RELATED APPLICATIONS

This application claims the benefit of U.S. Provisional Application No. 60/760,012, filed Jan. 18, 2006, the contents of which are incorporated herein by reference.

BACKGROUND OF THE INVENTION

The present invention generally relates to vapor-compression cycle equipment, and more particularly to determining the level of refrigerant charge using low-cost non-invasive measurements obtained while the system is operating.

Vapor-compression cycle systems include air conditioners, heat pumps, chillers, refrigerators, coolers, etc. Proper refrigerant charge (the amount of refrigerant contained in the system) is essential for a vapor-compression cycle system to operate efficiently and safely. Charging charts are often employed to adjust an existing refrigerant level during the operation of vapor-compression cycle systems with refrigerant recovery. However, this technique does not provide quantitative information on charge level, and therefore can lead to a system being overcharged or undercharged. Current common practices for accurately determining the charge level in a vapor-compression cycle system require evacuating the system and weighing the removed refrigerant, a very time-consuming and costly procedure that involves removing existing mineral oil, recovering existing refrigerant, evacuating the system using a deep vacuum, and refilling the system with proper amounts of mineral oil and refrigerant.

In view of the above, various equipment and techniques have been proposed for diagnosing refrigerant charge levels in vapor-compression cycle systems. While most have been adapted to qualitatively indicate whether refrigerant charge is below or above acceptable limits, U.S. Pat. No. 6,571,566 to Temple et al. proposes a method for quantitatively determining system charge level. Temple et al. disclose that a quantitative determination can be obtained by establishing a relationship between at least one system operating parameter and refrigerant charge level, independent of ambient temperature conditions. For this purpose, Temple et al. disclose operating the system at various known refrigerant charge levels and under various known ambient temperature conditions, while monitoring the system with temperature sensors and pressure sensors to establish baseline data that can be used in an algorithm to determine refrigerant charge level during subsequent operation of the system. Temple et al. teach that, by measuring system pressures and temperatures while operating the system for a range of different refrigerant charges and ambient conditions, a model can be produced correlating the subcooling and superheat values of the system to corresponding refrigerant pressures. The model can be subsequently used to quantitatively determine the system charge level using empirical data regression.

Drawbacks to such an approach include the requirement to operate the system over a range of different refrigerant charges and ambient conditions, necessitating a considerable amount of labor to alter the ambient conditions and adjust the refrigerant charge, the latter of which incurs the risk of refrigerant leakage. Furthermore, pressure sensors are relatively expensive and their installation requires fittings that can further increase the probability of refrigerant leakage. The algorithm proposed by Temple et al. also is not well suited to monitor refrigerant charge level if faults other than incorrect refrigerant charge are present.

In view of the above, it would be desirable if an improved technique were available for non-invasively determining the refrigerant charge level in an operating vapor-compression cycle system.

BRIEF SUMMARY OF THE INVENTION

The present invention provides a method and apparatus suitable for quantitatively determining refrigerant charge levels in operating vapor-compression cycle systems using non-invasive measurements, and without operating the system at various charge levels and ambient conditions to produce a model from which charge levels in the system are subsequently obtained.

The method and apparatus are generally employed with a vapor-compression cycle system that includes a compressor, a condenser, an expansion device, an evaporator, a discharge line fluidically connecting the compressor to the condenser, a liquid line fluidically connecting the condenser to the expansion device, a distribution line fluidically connecting the expansion device to the evaporator, and a suction line fluidically connecting the evaporator to the compressor. According to the method of this invention, the system is monitored while operating to ascertain that the system is operating at approximately steady-state. The superheat and the subcooling of the system are then determined at the suction line and at the liquid line, respectively, and the refrigerant charge level is calculated based on the determined subcooling, the determined superheat, and rated operating conditions of the system, including rated refrigerant charge level, rated liquid line subcooling, and rated suction line superheat.

The apparatus of this invention includes a device or devices for monitoring the system while the system is operating to ascertain that the system is operating at approximately steady-state, a device or devices for determining the superheat and the subcooling of the system at the suction line and at the liquid line, respectively, and a device or devices for calculating the refrigerant charge level based on the determined subcooling, the determined superheat, and rated operating conditions of the system including rated refrigerant charge level, rated liquid line subcooling, and rated suction line superheat.

From the above, it can be appreciated that the present invention provides a method and apparatus capable of determining the level of refrigerant charge using low-cost non-invasive measurements obtained while the system is operating. In particular, the method and apparatus are able to quantitatively determine refrigerant charge levels based on readily available manufacturers' data, limited or no training data, and surface-mounted temperature sensors that do not disturb the operation of the system or risk leakage of refrigerant. As such, the present invention can be implemented at relatively low cost. Furthermore, the performance of the method and apparatus is not compromised by the existence of other system faults.

Finally, the invention is generic for all types of systems, in that a model is derived based on physical analysis of the vapor compression cycle system rather than from an empirical data regression. As a result, the method and apparatus can be implemented in the form of a permanently installed control or monitoring system to determine charge level and/or to automatically detect and diagnose low or high levels of refrigerant charge, or in the form of a standalone portable unit to determine charge level, such as by a technician during the process of adjusting refrigerant charge.

Other objects and advantages of this invention will be better appreciated from the following detailed description.

DETAILED DESCRIPTION OF THE INVENTION

Figure 1:
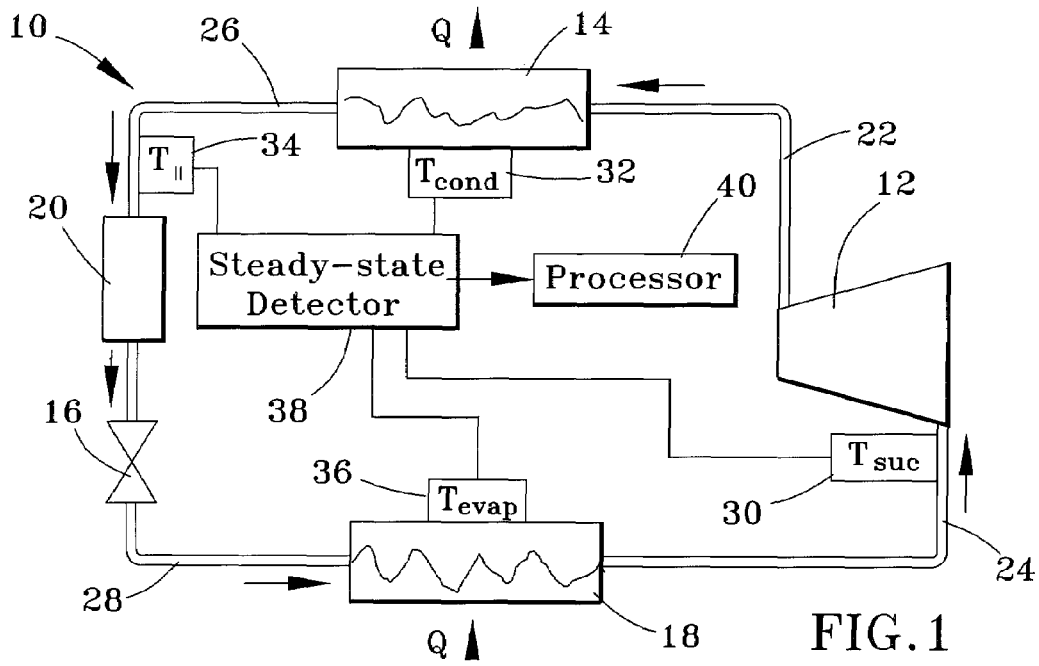
FIG. 1 schematically represents a refrigeration system whose refrigerant charge level can be determined and monitored with only temperature sensors in accordance with a preferred embodiment of this invention.

A typical vapor-compression refrigeration cycle system 10 is illustrated in FIG. 1. The system 10 includes a compressor 12, a condenser 14, an expansion device 16, and an evaporator 18. As is common, FIG. 1 also shows a filter/drier 20 installed in the system 10 between the expansion device 16 and evaporator 18. The various components of the system 10 can be fluidically connected with conduits, such as copper tubing or any other fluidic connections.

As known in the art, the compressor 12 increases pressure in the system 10 by compressing a refrigerant vapor. The conduit connecting the outlet of the compressor 12 to the condenser 14 is typically referred to as a discharge line 22, and thermodynamic states of the refrigerant within the discharge line 22, for example, pressure, temperature, enthalpy, etc., are referred to as, for example, discharge pressure, discharge temperature, discharge enthalpy, etc. The conduit connecting the inlet 26 of the compressor 12 to the evaporator 18 is typically referred to as the suction line 24, and thermodynamic states of the refrigerant within the suction line 24, for example, pressure, temperature, enthalpy, etc., are referred to as, for example, suction pressure, suction temperature, suction enthalpy, etc.

As indicated in FIG. 1, the condenser 14 converts superheated refrigerant vapor exiting the compressor 12 to liquid by rejecting heat to the surroundings. For this purpose, the condenser 14 can be equipped with coils through which the refrigerant flows while (typically) air from the surroundings is forced over the coils. In a typical condenser 14, the superheated refrigerant vapor is first cooled to form a saturated vapor, which then undergoes a phase change from saturated vapor to saturated liquid, after which the saturated liquid is further subcooled before exiting the condenser 14. The conduit connecting the condenser 14 to the expansion device 16 is typically referred to as a liquid line 26, and refrigerant thermodynamic states, for example, pressure, temperature, enthalpy, etc., within the liquid line 26 are referred to as liquid pressure, liquid temperature, liquid enthalpy, etc.

The expansion device 16 reduces the pressure and regulates the refrigerant flow to the inlet of the evaporator 18 through what is often termed the distribution line 28. Typically, refrigerant exiting the expansion device 16 is in a two-phase state. Expansion devices used in vapor-compression systems are generally of two types, fixed-area and adjustable throat-area devices, either of which can be used in the system 10.

The evaporator 18 is represented in FIG. 1 as absorbing heat from the environment, causing the two-phase refrigerant to vaporize and become superheated. As with the condenser 14, heat transfer between the refrigerant and the environment is promoted by equipping the evaporator 18 with coils through which the refrigerant flows while (typically) air from the environment is forced over the coils. The superheated vapor then exits the evaporator 18 and enters the compressor 12 via the suction line 24 to begin the next cycle.

As conventional in the art, the system 10 can be described as having high side and low side regions. As used herein, the high side is defined as that portion of the system 10 containing the high pressure vapor and liquid refrigerant, and rejects heat via the condenser 14. As such, the high side of the system 10 includes the discharge line 22, the condenser 14, and the liquid line 26. As used herein, the low side is defined as that portion of the system 10 containing the low pressure liquid vapor and refrigerant, and absorbs heat with the evaporator 18. As such, the low side of the system 10 includes the distribution line 28, the evaporator 18, and the suction line 24.

As well known in the art, various system faults can occur individually or simultaneously within the system 10, and are capable of degrading system efficiency, cooling capacity, and sensible heat ratio (SHR), and even endanger system safety. For example, for efficient and safe operation of the system 10, it is essential that the system 10 is properly charged, with the refrigerant charge level being neither too high nor too low relative to an optimum charge level or range for the system 10 established by its manufacturer. An undercharged system, which can result from an initially undercharged system or refrigerant leakage during system operation, is not only unable to provide sufficient cooling or heating capacity, but is also vulnerable to compressor burnout. An overcharged system also has reduced efficiency, as well as being vulnerable to compressor slugging. In addition, efficient and safe operation of the system 10 also require that the coils of the condenser 14 and evaporator 18 are clean and have enough air flow through them, as condenser and evaporating fouling not only lead to lower efficiency (by dirt buildup acting as an insulating layer on the coils) and heating/cooling capacity, but also endanger compressor safety. Similarly, the filter/drier 20 should also be reasonably clean, as a plugged or saturated filter/drier 20 will result in lower efficiency, lower capacity, and compressor overheating. Other potential system faults that can reduce system efficiency and safety include compressor valve leakage, liquid line restrictions, and the use of a non-condensable gas.

The above-noted conditions are common faults in vapor-compression systems of the type represented in FIG. 1. With prompt diagnosis of a fault, energy can be saved, comfort and productivity can be maintained, and the environment protected. Among the above-noted faults, refrigerant charge faults tend to be most problematical with existing diagnostic equipment and techniques because charge faults are system-level faults and very difficult to detect, particularly if other faults also exist in the system.

As a solution, the present invention provides a charge level measurement system and method, which include a technique for obtaining system data, a measurement processing technique, and a refrigerant charge gauge algorithm capable of automatically and accurately determining the refrigerant charge level in a vapor-compression cycle system (e.g., 10 in FIG. 1) under various operating conditions, including the presence of other system faults.

As represented in FIG. 1, the system 10 is equipped with four temperature sensors 30, 32, 34, and 36 that non-invasively monitor the system 10 through surface measurements taken at the suction line 24 (suction line temperature, $T_{suc}$), liquid line 26 (liquid line temperature, $T_{ll}$), condensing temperature ($T_{cond}$) and evaporating temperature ($T_{evap}$). As used herein, the term non-invasive (or non-invasively) means that the refrigerant-carrying structures of the system 10 are not physically breached, such that there is no risk of losing refrigerant. Essentially any type of temperature transducer can be used that is capable of producing a useful output signal, for example, thermistors and thermocouples widely available from numerous sources. The sensors 30, 32, 34, and 36 are used in conjunction with a measurement processing technique that uses a steady-state detector 38 to filter out transient data. While various algorithms could be used by the steady-state detector 38 to determine whether the system 10 is operating at steady state, the steady-state detector 38 preferably uses a combined slope and variance steady-state detection algorithm to compute the slope (k) using the best-fit line of Equation (1) below through a fixed-length sliding window of recent measurements and standard deviation (S) thereof using Equation (2). If the slope and deviation are both smaller than corresponding thresholds ($k_{th}$ and $S_{th}$), the system 10 is deemed to have reached steady-state operation. The sliding window is specified by the number (n) of data points ($y_m$, $y_{m+1}$, . . . $y_{m+n-1}$) and sampling time (t).

$$y_i = a + k(i-m)t,\ i = m, m+1, \ldots m+n-1) \tag{1}$$

$$S = \sqrt{(1/n)\sum_{i=m}^{m+-1}\left(y_i - (1/n)\sum_{i=m}^{m+n-1} y_i\right)} \tag{2}$$

The above-noted refrigerant charge gauge algorithm preferred by the present invention is set forth as Equation (3) below, and estimates the system charge level by relating condenser subcooling and evaporator superheat to the system charge level. While the charge gauge algorithm can be performed with a processor 40 as represented in FIG. 1, it will be appreciated that other computing devices could be used for this purpose, including a personal computer.

$$(m_{total}-m_{total,rated})/m_{total,rated}=(1/k_{ch})\{(T_{sc}-T_{sc,rated})-k_{sh/sc}(T_{sh}-T_{sh,rated})\} \tag{3}$$

In Equation (3), $m_{total}$ is the actual total refrigerant charge level, $m_{total,rated}$ is the nominal total refrigerant charge level rated by the manufacturer, $T_{sc,rated}$ is the rated liquid line subcooling for the system 10, and $T_{sh,rated}$ is the rated suction line superheat for the system 10. $T_{sc}$ is the actual measured liquid line subcooling calculated as the difference between the condensing temperature $T_{cond}$ (measured by the sensor 32) and the liquid line temperature $T_{II}$ (measured by the sensor 34), and $T_{sh}$ is the actual measured suction line superheat calculated as the difference between the suction line temperature $T_{suc}$ (measured by the sensor 30) and the evaporating temperature $T_{evap}$ (measured by the sensor 36). Finally, if $m_{total}$ is equal to $m_{total,rated}$ (representing a properly charged system), then $$k_{sh/sc}=(T_{sc}-T_{sc,rated})/(T_{sh}-T_{sh,rated}) \tag{4a}$$

where $k_{sh/sc}$ is the slope of a straight line plot of ($T_{sc}-T_{sc,rated}$) versus ($T_{sh}-T_{sh,rated}$) for the rated refrigerant charge for the system 10. As such, $$\begin{aligned} k_{sh/sc} &= (T_{sc,1}-T_{sc,2})/(T_{sh,1}-T_{sh,2}) \\ &= \Delta T_{sc}/\Delta T_{sh} \end{aligned} \quad \text{and} \tag{4b}$$

-continued $$\begin{aligned} k_{sh/sc} &= \Delta T_{sc}/\Delta T_{sh} \\ &= (\Delta T_{sc}/\Delta \mathrm{dc})/(\Delta T_{sh}/\Delta \mathrm{dc}) \\ &= (\partial T_{sc}/\partial \mathrm{dc})/(\partial T_{sh}/\partial \mathrm{dc}) \\ &= k_{sc|\mathrm{dc}}/k_{sh|\mathrm{dc}} \end{aligned} \tag{4c}$$

In order to evaluate the ratio represented by $k_{sh/sc}$ in Equation (4a), it is only necessary to have measurements of superheat and subcooling at the rated condition and a second operating condition. Theoretically, it does not matter what conditions were changed in order to effect a change in subcooling and superheat. For example, a suitable change in subcooling and superheat could result from a change in condenser inlet temperature or flow rate, evaporator inlet temperature, humidity, or flow rate, or any combination of these variables. Equation (4a) is essentially equivalent to calculating the derivative of a straight line, so it is very sensitive to the variation amplitude in $T_{sc}(T_{sc}-T_{sc,rated})$ and $T_{sh}(T_{sh}-T_{sh,rated})$ and uncertainties in its parameters of $T_{sc}$, $T_{sc,rated}$, $T_{sh}$, and $T_{sh,rated}$ In particular, $T_{sc,rated}$ and $T_{sh,rated}$ are typically estimated and rounded by air-conditioning system manufacturers, so they may incur significant errors. For example, if $T_{sc}$=8±0.5C, $T_{sh}$=9±0.5C, $T_{sc,rated}$=7±1C, $T_{sh,rated}$=6±1C, then $k_{sh/sc}$=0.33±0.39 and the uncertainty in $k_{sh/sc}$ is up to ±118%.

Equation (4b) eliminates $T_{sc,rated}$ and $T_{sh,rated}$, and instead uses two pairs of actual measurements, ($T_{sc,1}$, $T_{sh,1}$) and ($T_{sc,2}$, $T_{sh,2}$). Since these pairs of measurements are obtained with the temperature sensors 30-36 at fixed locations in the system 10, offset errors can be eliminated. In addition, if amplitudes of $\Delta T_{sc}$ and $\Delta T_{sh}$ are significant, a much more robust $k_{sh/sc}$ can be obtained from Equation (4b).

In Equation (4c), dc denotes "driving condition," which can be condenser inlet air temperature and flow rate, and evaporator inlet air temperature and humidity and flow rate. $k_{sc|dc}$ and $k_{sh|dc}$ are defined as the partial derivative of $T_{sc}$ and $T_{sh}$ with respect to a given driving condition. Since $T_{sc}$ and $T_{sh}$ are strong linear functions of driving conditions, $k_{sc|dc}$ and $k_{sh|dc}$ can be obtained by linear regression of a set of measurements. $k_{sh/sc}$ can be obtained by evaluating $k_{sc|dc}/k_{sh|dc}$. In this manner, offset errors can be eliminated and random errors can be suppressed significantly, so the uncertainty in estimating $k_{sh/sc}$ is reduced significantly. The other contribution of Equation (4c) is that it relates the system charge-subcooling and charge-superheat characteristics to the characteristics of subcooling-driving conditions and superheat-driving conditions. Among all the driving conditions, the condenser inlet air temperature (or ambient temperature) is believed to be the best driving condition for estimating $k_{sh/sc}$. First, the refrigerant charge residing in the condenser inlet (high side) accounts for most of the system total charge and thus high side driving conditions, to which the high side charge is highly related, should be weighed more and are preferable. Secondly, between the high side driving conditions of ambient temperature and air flow rate, the ambient temperature is more practical and reliable.

An underlying assumption for the derivation of Equation (3) was that, for a given heat exchanger, the liquid volume is a unique function of subcooling and vice versa. However, the liquid volume is also a function of CTOA (condensing temperature over ambient air temperature). Under a higher CTOA, the same subcooling degree requires less heat transfer area and thus corresponds to less liquid volume and less liquid mass. Since CTOA is fairly constant under normal operating conditions for a fixed fan speed, the underlying assumption is valid. However, CTOA is inversely proportional to air flow rates. Therefore, under different air flow rates, the same subcooling degree may result for different charge levels. For unitary air conditioners, $k_{sh/sc}$ ranges from ¼ to ½.

If the system 10 uses a thermal expansion valve (TXV) as the expansion device 16, the dependence of $T_{sh}$ and $T_{sc}$ on refrigerant charge levels, condenser inlet air temperatures, and outdoor air flow rates is different than if the system 10 uses a fixed orifice (FXO) as the expansion device 16. Within the capacity of the flow control of a TXV, $T_{sh}$ only fluctuates within a small range around the rating value. In this case, the refrigerant inventory in the evaporator 18 is relatively constant within the capacity of the flow control of the expansion device (TXV) 16, and $$k_{sh/sc}(T_{sh}-T_{sh,rated})\approx(T_{sh}-T_{sh,rated})\approx 0$$

When a TXV is fully open, it cannot maintain the rated superheat and acts like an FXO, and $k_{sh/sc}$ can be estimated using procedures for FXO systems. To simplify parameter estimation, $k_{sh/sc}$ can be approximated as the average value for FXO systems, or about ½.5.

The constant $k_{ch}$ is an empirical constant in Equation (3), and can be calculated using Equation (5) below.

$$k_{ch}=(m_{total,rated}/k_{sc})=T_{sc,rated}/(1-\alpha_{hs,o,rated})X_{high,rated}) \quad (5)$$

Equation (5) consists of two equations:

$$k_{ch}=m_{total,rated}/k_{sc} \quad (5a)$$

and $$k_{ch}=T_{sc,rated}/(1-\alpha_{hs,o,rated})X_{high,rated}) \quad (5b)$$

and thus provides two ways to calculate $k_{ch}$. In Equation (5a), $k_{sc}$ is defined as the rate at which the high side refrigerant mass varies with the liquid line subcooling. Whereas Equation (5a) requires multiple charge levels to calculate $k_{sc}$, Equation (5b) does not. Furthermore, $\alpha_{hs,o,rated}$ is defined as the fraction of the rated refrigerant charge under which the liquid line exit will have saturated liquid at the rated operating conditions, and $X_{high,rated}$ is defined as the ratio of high side rated charge over the total rated charge. As such, $\alpha_{hs,o,rated}$ and $X_{high,rated}$ are constants for a given system, and their values vary very little among different systems. Since $T_{sc,rated}$, $\alpha_{hs,o,rated}$, and $X_{high,rated}$ are nearly constant according to a similarity principle, $m_{total,rated}/k_{sc}$ is also relatively constant. If there are no data available, 50° C. is a reasonable value for $k_{ch}$ in Equation (3).

The lefthand side of Equation (3), which again is $$(m_{total}-m_{total,rated})/m_{total,rated}=(1/k_{ch})\{(T_{sc}-T_{sc,rated})-k_{sh/sc}(T_{sh}-T_{sh,rated})\} \quad (3)$$

is an excellent charge indicator, as it is the percentage of deviation from nominal charge. Equation (3) can be rewritten to solve for the actual total refrigerant charge level ($m_{total}$) of the system 10 with as follows:

$$m_{total}=m_{total,rated}+(m_{total,rated}/k_{ch})\{(T_{sc}-T_{sc,rated})-(k_{sh/sc})(T_{sh}-T_{sh,rated})\} \quad (3a)$$

If the above-noted approximated values for $k_{ch}$ and $k_{sh/sc}$ (50 and ½.5, respectively) are used, Equation (3a) can then be rewritten as follows:

$$m_{total}=m_{total,rated}+(m_{total,rated}/50)\{(T_{sc}-T_{sc,rated})-(½.5)(T_{sh}-T_{sh,rated})\} \quad (3b)$$

Equation (3) (and conversely, Equations (3a) and (3b)) is believed to be an excellent tool for diagnosing refrigerant leakage, undercharge, or overcharge. Although it is not necessary to know the constant, $k_{ch}$, in Equation (3) in order to perform FDD (fault detection and diagnostics) on the system 10, it could be determined if data are available at multiple charge levels, based on Equation (5a). On the other hand, Equation (5b) evidences that $k_{ch}$ can be accurately estimated without any data at multiple charge levels. As such, Equation (3) acts as a virtual sensor for refrigerant charge whose inputs include manufacturer's data and optionally a few data points for training (e.g., Equation (5a)), though notably very good approximations of the model parameters can be achieved without any training data (based on Equation (5b)). As such, Equation (3) determines the refrigerant charge of the system 10 based on a model derived from physical analysis of a vapor-compression cycle system, rather than from an empirical data regression as done by Temple et al., and is therefore generic for essentially all types of vapor-compression cycle systems.

In an investigation carried out to verify the capabilities of the present invention, a split air-conditioning system with a TXV as the expansion device and R410a (difluoromethane and pentafluoroethane) as the refrigerant was tested. Refrigerant charge was varied from 60% to 140% of the nominal charges under various ambient temperatures in a range of about 27 to about 52° C., various indoor wet bulb temperature conditions in a range of about 12 to about 23° C., different evaporator air flow rates in a range of about 50% to about 140% of its nominal value, and different condenser air flow rates in a range of 32% to about 100% of its nominal value. At rated conditions of an ambient temperature ($T_{amb}$) of 35° C., a dry bulb temperature ($T_{db}$) of 26.7° C., and a wet bulb temperature ($T_{wb}$) of 15.7° C., the test system had the following rated parameters: $T_{sc,rated}$=6.7° C., $T_{sh,rated}$=4.5° C., $X_{high,rated}$=0.75, and $\alpha_{o,rated}$=0.84. Solving Equation (5b) gives the following solution:

$$k_{ch}=6.7°\text{ C.}/(1-0.84)0.75=55.8°\text{ C.}$$

As previously noted, for a system containing a thermal expansion valve (TXV) as the expansion device, $k_{sh/sc}$ can be approximated as ½.5, and Equation (3) is $$(m_{total}-m_{total,rated})/m_{total,rated}=(½5.8)\{(T_{sc}-6.7)-(½.5)(T_{sh}-4.5)\}$$

Figure 2:
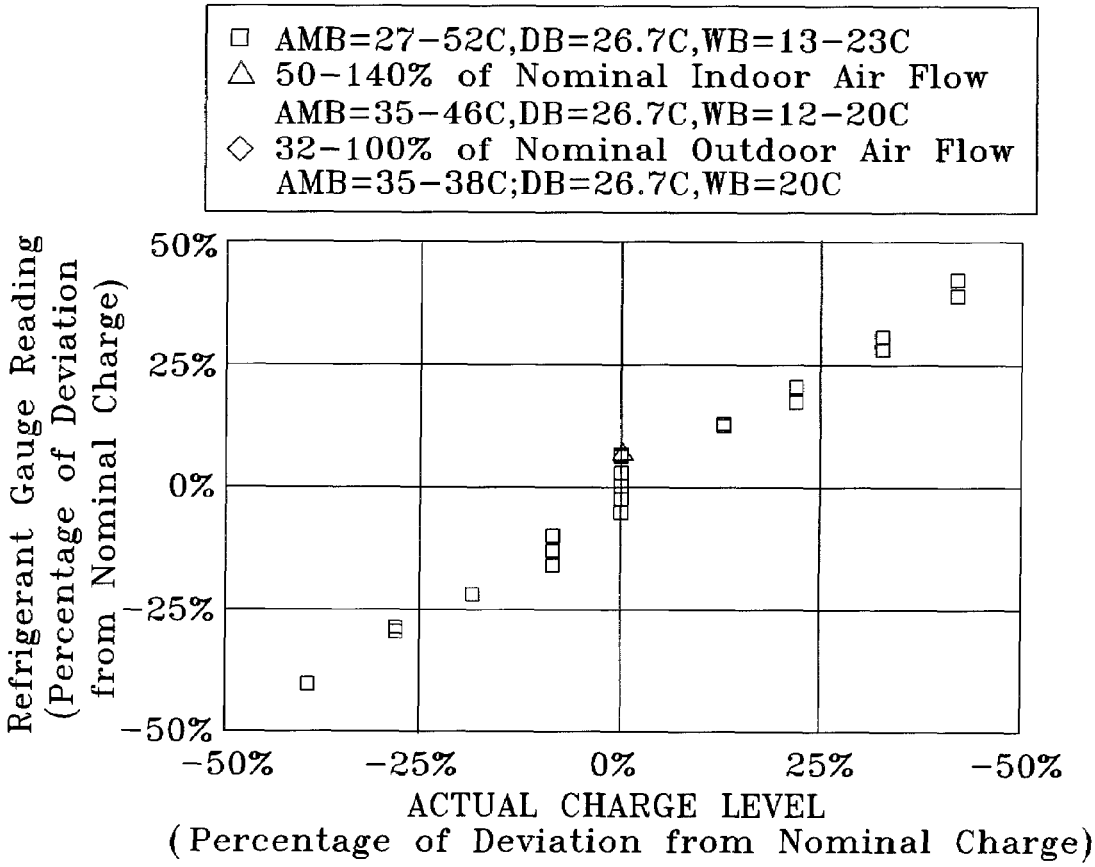
FIG. 2 is a graph plotting estimated versus actual refrigerant charge levels in a split air-conditioning system, in which the estimated refrigerant charge levels were determined in accordance with the present invention.

FIG. 2 plots the charge level calculated by solving for the percentage of deviation from nominal charge ($(m_{total}-m_{total,rated})/m_{total,rated}$) in the equation immediately above for different operating conditions of the evaluated air-conditioning system. Overall, it can be seen that the estimation obtained with the invention is nearly linear with the actual refrigerant charge of the system, and is independent of operating conditions and other faults, all of which appears to validate the estimation capability of Equation (3).

While the invention has been described in terms of a preferred embodiment, it is apparent that other forms could be adopted by one skilled in the art. Therefore, the scope of the invention is to be limited only by the following claims.

The invention claimed is:

1. A method of non-invasively determining a charge level ($m_{total}$) of a refrigerant in a vapor-compression cycle system comprising a compressor, a condenser, an expansion device, an evaporator, a discharge line fluidically connecting the compressor to the condenser, a liquid line fluidically connecting the condenser to the expansion device, a distribution line fluidically connecting the expansion device to the evaporator, and a suction line fluidically connecting the evaporator to the compressor, the method comprising:

monitoring the system while operating the system to ascertain that the system is operating at approximately steady-state;

determining the superheat ($T_{sh}$) and the subcooling ($T_{sc}$) of the system at the suction line and at the liquid line, respectively; and calculating the refrigerant charge level ($m_{total}$) based on the determined subcooling ($T_{sc}$), the determined superheat ($T_{sh}$), and rated operating conditions of the system including rated refrigerant charge level ($m_{total,rated}$), rated liquid line subcooling ($T_{sc,rated}$), and rated suction line superheat ($T_{sh,rated}$) using the equation $$(m_{total}-m_{total,rated})/m_{total,rated}=(1/k_{ch})\{(T_{sc}-T_{sc,rated})-k_{sh/sc}(T_{sh}-T_{sh,rated})\}$$

wherein $k_{ch}$ is and empirical constant and $k_{sh/sc}$ is the slope of a straight line plot of ($T_{sc}-T_{sc,rated}$) versus ($T_{sh}-T_{sh,rated}$) for the rated rrefrigerant charge for the system; and then adjusting the charge level of the refrigerant in the system in response to the calculated refrigerant charge level of the system.

2. The method according to claim 1, wherein $T_{sc}$ is determined by calculating the difference between the temperature of the refrigerant in the liquid line and the temperature of the refrigerant in the condenser, and $T_{sh}$ is determined by calculating the difference between the temperature of the refrigerant in the suction line and the temperature of the refrigerant in the evaporator.

3. The method according to claim 1, wherein $k_{ch}$ is calculated with the equation $$T_{sc,rated}/(1-\alpha_{hs,o,rated})X_{high,rated})$$

wherein $\alpha_{hs,o,rated}$ is the fraction of the rated refrigerant charge level ($m_{total,rated}$) under which the refrigerant is saturated liquid at an exit of the liquid line under the rated operating conditions, and $X_{high,rated}$ is the ratio of rated refrigerant charge level at a high side of the system over the rated refrigerant charge level ($m_{total,rated}$) of the system.

4. The method according to claim 1, wherein $k_{ch}$ is about 50° C.

5. The method according to claim 1, wherein $k_{sh/sc}$ is between about ¼ to about ½.

6. The method according to claim 1, wherein $k_{sh/sc}$ is about ½.5.

7. The method according to claim 1, wherein the determining and calculating steps are performed without training the system to develop a model correlating the subcooling and superheat of the system to refrigerant pressures in the system, and without empirical data regression.

8. An apparatus for non-invasively determining a charge level ($m_{total}$) of a refrigerant in a vapor-compression cycle system comprising a compressor, a condenser, an expansion device, an evaporator, a discharge line fluidically connecting the compressor to the condenser, a liquid line fluidically connecting the condenser to the expansion device, a distribution line fluidically connecting the expansion device to the evaporator, and a suction line fluidically connecting the evaporator to the compressor, the apparatus comprising:

means for monitoring the system while operating the system to ascertain that the system is operating at approximately steady-state;

means for determining the superheat ($T_{sh}$) and the subcooling ($T_{sc}$) of the system at the suction line and at the liquid line, respectively; and means for calculating the refrigerant charge level ($m_{total}$) based on the determined subcooling ($T_{sc}$), the determined superheat ($T_{sh}$), and rated operating conditions of the system including rated refrigerant charge level ($m_{total,rated}$), rated liquid line subcooling ($T_{sc,rated}$), and rated suction line superheat ($T_{sh,rated}$), the calculation means calculating the refrigerant charge level ($m_{total}$) with the equation $$(m_{total}-m_{total,rated})/m_{total,rated}=(1/k_{ch})\{(T_{sc}-T_{sc,rated})-k_{sh/sc}(T_{sh}-T_{sh,rated})\}$$

wherein $k_{ch}$ is an empirical constant and $k_{sh/sc}$ is the slope of a straight line plot of ($T_{sc}-T_{sc,rated}$) versus ($T_{sh}-T_{sh,rated}$) for the rated refrigerant charge for the system.

9. The apparatus according to claim 8, wherein the determining means determines $T_{sc}$ by calculating the difference between the temperature of the refrigerant in the liquid line and the temperature of the refrigerant in the condenser, and determines $T_{sh}$ by calculating the difference between the temperature of the refrigerant in the suction line and the temperature of the refrigerant in the evaporator.

10. The apparatus according to claim 8, wherein the calculating means calculates $k_{ch}$ with the equation $$T_{sc,rated}/(1-\alpha_{hs,o,rated})X_{high,rated})$$

wherein $\alpha_{hs,o,rated}$ is the fraction of the rated refrigerant charge level ($m_{total,rated}$) under which the refrigerant is saturated liquid at an exit of the liquid line under the rated operating conditions, and $X_{high,rated}$ is the ratio of rated refrigerant charge level at a high side of the system over the rated refrigerant charge level ($m_{total,rated}$) of the system.

11. The apparatus according to claim 8, wherein $k_{ch}$ is about 50° C.

12. The apparatus according to claim 8, wherein $k_{sh/sc}$ is between about ¼ to about ½.

13. The apparatus according to claim 8, wherein $k_{sh/sc}$ is about ½.5.

14. The apparatus according to claim 8, wherein the determining means and calculating means operate without training the system to develop a model correlating the subcooling and superheat of the system to refrigerant pressures in the system, and without empirical data regression.

* * * * *